US005722571A

United States Patent [19]

Littlejohn

[11] Patent Number: 5,722,571

[45] Date of Patent: Mar. 3, 1998

[54] AIR FLOW GUIDE FOR GARMENT SLEEVE

[76] Inventor: Sondra Littlejohn, 7320 Piney Branch Rd., Takoma Park, Md. 20912-4207

[21] Appl. No.: 579,352

[22] Filed: Dec. 27, 1995

[51] Int. Cl.[6] ..... A41H 43/00

[52] U.S. Cl. ..... 223/1; 493/939

[58] Field of Search ..... 223/1, 84, 83, 223/82, 81, 52.1; 493/939, 276, 968; 602/62, 63, 20

[56] References Cited

U.S. PATENT DOCUMENTS

| | | | |
|---|---|---|---|
| 1,923,856 | 8/1933 | Wasser | 223/83 |
| 2,586,078 | 2/1952 | O'Malley | 493/276 |
| 3,382,779 | 5/1968 | Lynas | 493/276 |
| 3,508,372 | 4/1970 | Wallerstein | 493/276 |
| 3,621,991 | 11/1971 | Richter | 223/85 |
| 3,926,186 | 12/1975 | Nirshl | 602/62 |
| 5,357,633 | 10/1994 | Rael | 2/16 |
| 5,395,307 | 3/1995 | Fan | 602/63 |

FOREIGN PATENT DOCUMENTS

| | | | |
|---|---|---|---|
| 3811900 | 5/1989 | Germany | 602/62 |
| 597851 | 4/1978 | Switzerland | 602/62 |
| 25737 | 11/1904 | United Kingdom | 223/83 |
| 405771 | 2/1934 | United Kingdom | 223/84 |
| 904809 | 8/1962 | United Kingdom | 223/83 |

*Primary Examiner*—Bibhu Mohanty
*Attorney, Agent, or Firm*—Sughrue, Mion, Zinn, Macpeak & Seas, PLLC

[57] ABSTRACT

An air flow guide for a garment sleeve is formed from an elongated, flat strip of flexible, semi-stiff material adapted to be rolled into an adjustable diameter tube and inserted into a garment sleeve adjacent a cuff portion thereof. Hook and eye type fastening means are provided on the strip of material for detachably securing the strip in the desired diameter tubular configuration. A strap may be detachably connected to the tube for securing the tube to the forearm of a wearer to properly position the tube to direct a flow of air into the garment through the garment sleeve.

3 Claims, 3 Drawing Sheets

AIR FLOW GUIDE FOR GARMENT SLEEVE

BACKGROUND OF THE INVENTION

The present invention is directed to an air flow guide for a garment sleeve and more specifically to an adjustable diameter tubular member adapted to be disposed in a sleeve of a garment adjacent the cuff thereof to direct a flow of air into the body of the garment when the arm of the wearer is disposed on a window sill of a moving vehicle.

Many people do not ride in air conditioned vehicles for various reasons. Some do not own an air conditioned vehicle and others wish to reduce the reliance upon air conditioner use, either by reason of economy or by preference for fresh air. When riding in a non air conditioned vehicle on a warm day, such people seek alternative ways to improve the flow of air through the vehicle to help cool the interior of the vehicle and the person riding in the vehicle. The use of fans, sun roofs and ventilated seat cushions are used to facilitate the flow of air through the passenger compartment to lower the temperature therein.

Many passengers in a motor vehicle, especially the driver, like to drive with the window open and an arm on the window sill. Depending upon the type of garment worn by the wearer, a certain amount of air flow generated by the moving vehicle is directed through the sleeve of the garment, which is located on the window sill of the vehicle. However, unless the sleeve of the garment is angled in exactly the right position relative to the flow of air, it is difficult to maintain the cuff of the sleeve in an opened condition to permit the entry of air into the sleeve.

There have been many attempts to regulate the flow of air through a garment. Frequently, the attempts are for the purpose of preventing the flow of air through a garment worn in a high air flow environment, such as a motorcyclist's suit or a sky diver's suit. The U.S. Patent to Garcia (U.S. Pat. No. 3,805,295) discloses such a wind resistant suit construction which utilizes, inter alia, an adjustable diameter, tubular sleeve member which is adapted to wrap tightly about the wrist of a wearer to prevent the flow of air up the sleeve into the interior of the garment. For those garments which seek to admit air into the interior of a garment for the purpose of cooling, the most common provision is the use of mesh panels, which permit the entry of air into the body of the garment.

Arm protective garments are also known for protecting the left arm of a motorist driving a motor vehicle when the motorist places the left arm on the window sill. The patent to Rael (U.S. Pat. No. 5,357,633) discloses a tubular sleeve member which may be detachably secured on the arm of the motorist to protect the arm against windburn and sunburn. However, such protective garments do not allow for increased ventilation to the interior of a body garment.

SUMMARY OF THE INVENTION

The present invention provides a new and improved air flow guide for a garment sleeve comprised of an elongated flat strip of flexible, semi-stiff material adapted to be rolled into an adjustable diameter tubular member and inserted into a garment sleeve adjacent a cuff portion thereof. Adjustable securing means may be provided on the strip of material for detachably securing the strip in the desired diameter tubular configuration. Additional means may be provided to engage the material of the garment sleeve to help hold the tubular member in position or additional means may be provided for detachably and adjustably securing the tubular member to an arm of a wearer.

The above and other objects, features and advantages of the present invention will be more apparent and more readily appreciated from the following detailed description of preferred exemplary embodiment of the present invention, taken in connection with the accompanying drawings.

DETAILED DESCRIPTION OF THE INVENTION

Figure 1:
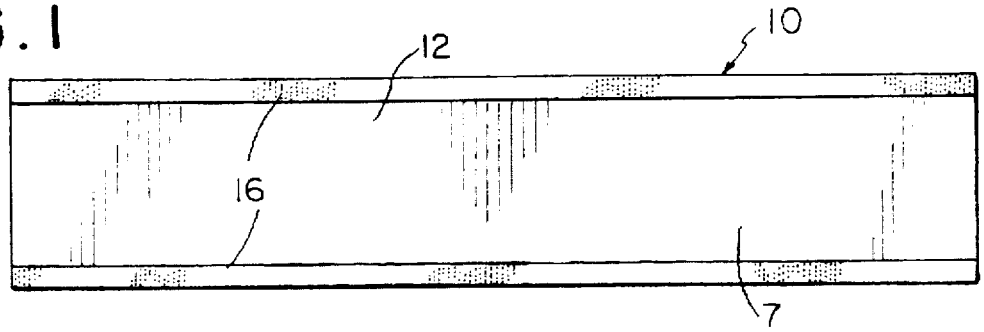
FIG. 1 is a plan view of the elongated strip of material constituting an air flow guide in a flat condition.
Figure 2:
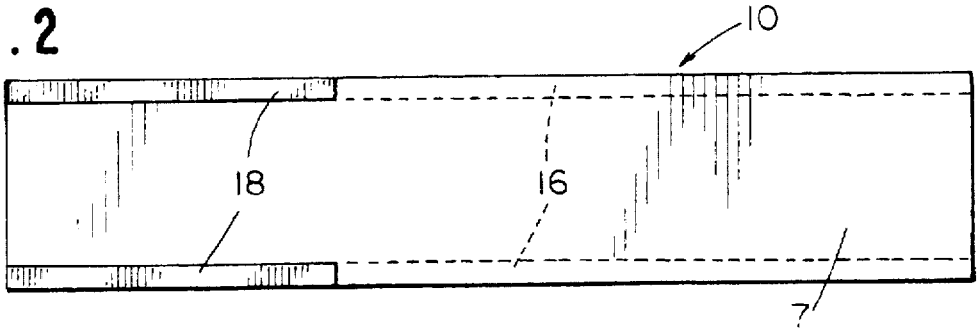
FIG. 2 is a bottom plan view of the strip shown in FIG. 1.
Figure 5:
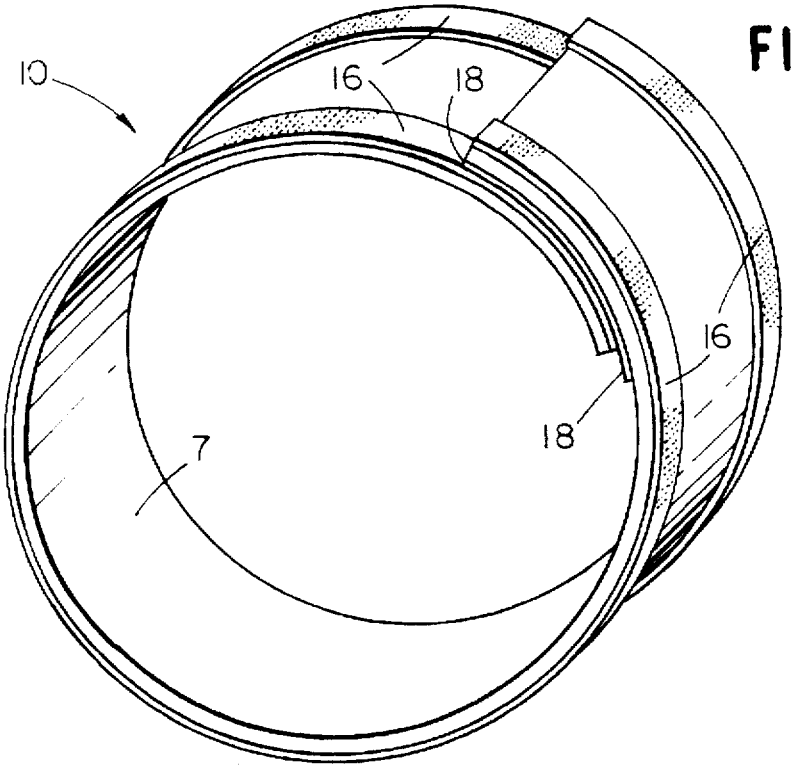
FIG. 5 is a perspective view of a tubular air guide formed from the strip shown in FIG. 1.
Figure 7:
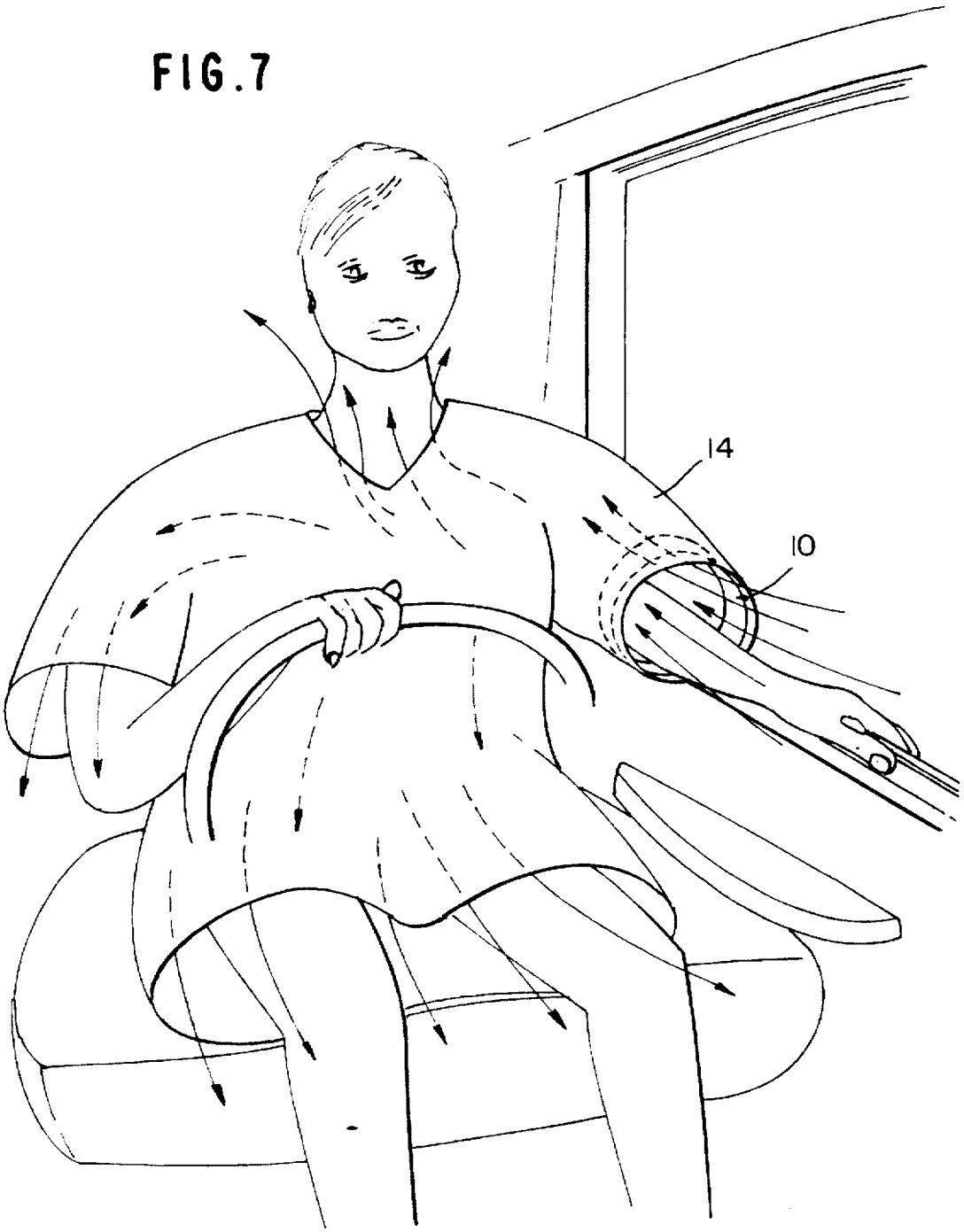
FIG. 7 is a perspective view of the tubular air guide located in a sleeve of a garment on a motorist showing the flow of air through the garment.

An air flow guide 10 for a garment sleeve, according to a first embodiment of the present invention, is shown in FIGS. 1 and 2 and is comprised of an elongated flat strip 12 of flexible, semi-stiff material which may be rolled into an adjustable diameter tube as shown in FIG. 5 and inserted into a garment sleeve 14, as shown in FIG. 7. One side of the strip 7, as shown in FIG. 1, is provided with two elongated fastener tapes 16, which are secured to the surface of the strip 7 along the longitudinal edges thereof by means of an adhesive, or any other suitable means. A pair of fastener tapes 18 complementary to the fastener tapes 16, are secured to the opposite surface of the strip 7, as shown in FIG. 2. The strips 18 are also secured along the longitudinal edges but only extend a limited distance, whereas the fastener tapes 16 extend along the entire length of the edges. Thus, when the strip 7 is rolled into a tubular form, as shown in FIG. 5, with one end of the strip overlapping the other, the fastener tapes 18 would be disposed on the inside of the tubular arrangement in overlapping engagement with the fastener tapes 16, which face outwardly of the tubular member. The opposite ends of the strip 7 may overlap to obtain any desired diameter for the tubular member whereupon the fastener tapes 16 and 18 will be pressed into connecting engagement with each other. The use of hook and eyelet type fastener such as a VELCRO fastener is preferred, but other types of fasteners such as snaps could be used. It is preferred to have the hook type members as the fastener tapes 16 so that the exposed portions of the tapes 16 in the tubular form of the sleeve can interact with the fabric of the garment sleeve 14 to help retain the tubular sleeve in the desired position within the sleeve.

Figure 3:
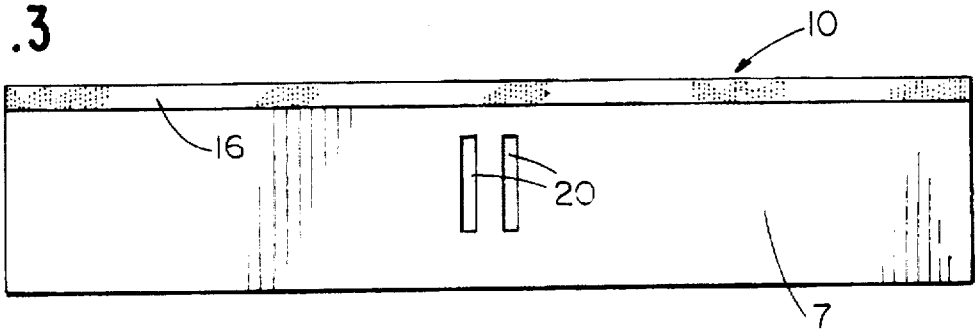
FIG. 3 is a top plan view of a modified strip of material for an air flow guide having slots for a securing strap.
Figure 4:
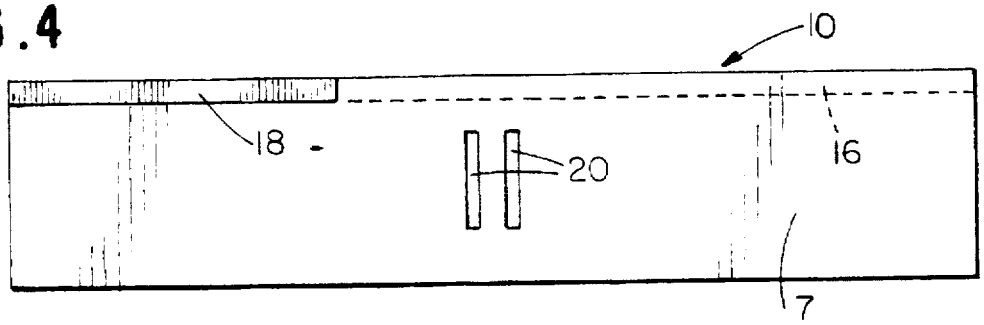
FIG. 4 is a bottom plan view of the strip shown in FIG. 3.
Figure 6:
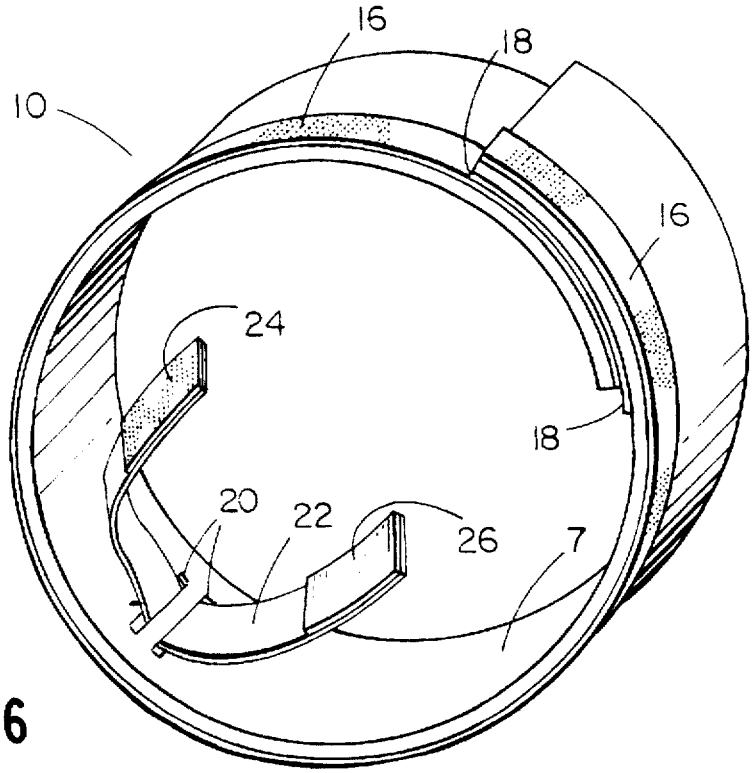
FIG. 6 is a perspective view of a tubular air guide formed from the strip of FIG. 3 with an adjustable strap extending through the slot.

The embodiment shown in FIGS. 3, 4 and 6 is similar to that disclosed in the embodiment of FIGS. 1 and 2 but only one fastener tape 16 and one fastener tape 18 are provided along one edge of the strip 7. When the strip 7 is formed into a tubular sleeve, as shown in FIG. 6, the fastener strips 16 and 18 will be pressed into engagement with each other.

Additionally, a pair of parallel transversely extending slots 20 are provided in the strip 7 for reception of a strap 22 as shown in FIG. 6. Complementary fastener elements 24 and 26 are secured to opposite faces of the strap 22 adjacent respective ends of the strap. The strap 22 which extends through the slots 20 may be wrapped about the forearm of a wearer with the fastener elements 24 and 26 engaging each other to hold the tubular sleeve on the arm of the wearer. Thus the point where the slots 20 are located, could be placed on the underside of the forearm which rests on the window sill of a motor vehicle so that the tubular element will extend about the upper side of the forearm in spaced relation thereto to facilitate the flow of air up the sleeve of the garment. Although the strap is not shown in FIG. 7, the disposition of the tubular sleeve would be the same. The slots and strap arrangement for securing the tubular sleeve to the forearm of a wearer could also be used in the embodiment of FIG. 1.

As best seen in FIG. 7, the location of the tubular sleeve 10 within the garment sleeve 14 holds the cuff of the sleeve in an open condition, thereby allowing a strong flow of air upwardly through the sleeve in the direction of the arrows during movement of the motor vehicle. The air may then pass through the interior of the garment to cool the body of the wearer before exiting through the neck opening, the opposite sleeve and the bottom of the garment, as shown by the arrows. Thus with the increased air flow provided by the tubular sleeve 10 located in the garment sleeve 14, a substantial cooling effect is provided for the driver of the motor vehicle. The tubular sleeve 10 could be used equally well in the opposite sleeve for a passenger on the opposite side of the motor vehicle as well as for a driver in a right-hand drive motor vehicle.

The tubular sleeve 10 may be of any desired material such as plastic or light cardboard. The thickness of the material should be sufficient to help the tubular sleeve maintain its tubular configuration with the overlapped ends secured to each other by means of the fastener strips. The fastener strips 24 and 26 secured to the strap 22 may also be of the complementary hook and eye type such as VELCRO or any other suitable fastener means such as snap fasteners. The length of the tapes 18 in the longitudinal direction of the strip 7 need only be sufficient to achieve the desired holding force when disposed in mating engagement with the fastener strips 16. It is preferable to have the fastener tapes 16 extend along the entire length of the strip 7, whereby the hook-like elements of the fastener tape 16 can engage with the fabric of the garment sleeve. The extent of engagement will vary depending upon the nature of the material of the garment sleeve. However, if such a fastening of the tubular sleeve to the garment sleeve is not possible or desirable, the length of the fastener tapes 16 need only be long enough to achieve the desired adjustability in the diameter of the tubular sleeve.

While the invention has been particularly shown and described with reference to preferred embodiments thereof, it will be understood by those in the art that the foregoing and other changes in form and details may be made therein without departing from the spirit and scope of the invention.

What is claimed is:

1. An air flow guide for a garment sleeve comprising an elongated flat strip of material having first and second surfaces on opposite sides of said strip adapted to be rolled into an adjustable diameter tube and inserted into a garment sleeve adjacent a cuff portion thereof and complementary adjustable securing means mounted on said first and second surfaces, respectively, of said strip of material for detachably and adjustably securing the strip in a tubular configuration, wherein said material is a flexible, semi-stiff material capable of maintaining a tubular configuration and further comprising additional securing means detachably connected to said strip of material for detachably and adjustably securing the tubular member to an arm of a wearer.

2. An air flow guide as set forth in claim 1, wherein said strip of material is provided with two parallel transversely extending slots and said additional securing means is comprised of a strap having complementary fastening means secured adjacent opposite ends of said strap for adjustable engagement to secure said strap about an arm of a wearer.

3. An air flow guide for a garment sleeve comprising an elongated flat strip of material having first and second surfaces on opposite sides of said strip adapted to be rolled into an adjustable diameter tube and inserted into a garment sleeve adjacent a cuff portion thereof, first fastener means secured to said first surface and extending longitudinally of said strip from one end of said strip to an opposite end of said strip and second fastener means complementary to said first fastener means secured to said second surface adjacent one end of said strip whereby upon forming said strip into a tube with said first fastener means facing outwardly of said tube, said second fastener means engaging said first fastener means to maintain said tube in a desired adjusted tubular configuration and wherein said first fastener means is comprised of a fabric strip having a plurality of projecting hooks thereon and said second fastener means is comprised of a fabric strip having a plurality of complementary loops thereon engageable by said hooks, said hooks of said first fastener means being engageable with the material of the garment sleeve to assist in holding said tube within said garment sleeve and wherein said guide material is flexible, semi-stiff material capable of maintaining a tubular configuration.

* * * * *